US005117899A

United States Patent [19]

Skimehorn

[11] Patent Number: 5,117,899

[45] Date of Patent: Jun. 2, 1992

[54] AIR HANDLING APPARATUS

[76] Inventor: Tony A. Skimehorn, 218 S. 12th St., Chesterton, Ind. 46304

[21] Appl. No.: 694,776

[22] Filed: May 2, 1991

[51] Int. Cl.[5] ..... F24F 3/052; F24F 3/16

[52] U.S. Cl. ..... 165/48.1; 165/16; 165/22; 165/59; 165/119; 55/279; 55/312; 55/357; 55/496; 55/DIG. 35; 236/49.4; 236/13

[58] Field of Search ..... 165/59, 119, 16, 22, 165/48.1; 55/279, 312, 357, 496, DIG. 35; 236/49.4, 13

[56] References Cited

U.S. PATENT DOCUMENTS

| | | | |
|---|---|---|---|
| 2,284,764 | 6/1942 | Parks | 165/16 |
| 2,372,839 | 4/1945 | McGrath | 165/16 |
| 2,609,183 | 9/1952 | Fitzgerald | 165/22 |
| 2,609,743 | 9/1952 | Ashley et al. | 165/22 |
| 2,755,072 | 7/1956 | Kreuttner | 165/22 |
| 2,984,459 | 5/1961 | Waterfill | 165/22 |
| 3,176,759 | 4/1965 | Windham | 165/22 |
| 3,441,080 | 4/1969 | Church | 165/22 |
| 3,623,543 | 11/1971 | Ostrander | 165/22 |
| 3,901,310 | 8/1975 | Strawn | 165/22 |

*Primary Examiner*—John K. Ford
*Attorney, Agent, or Firm*—Leon Gilden

[57] ABSTRACT

The air handling apparatus provides a separate heating mixing air deck and a separate cooling mixing air deck each with their own return air and outdoor air supplies to maximize indoor air directed to the heating deck and monitor the cooling deck to utilize either return or outside air for greatest efficiency in the cooling deck. Near the rooms serviced by the system the air from the respective heating and cooling decks is mixed and directed through a control plate which can accommodate various filters including a germicide type. The control plate also has a bypass door allowing the filter to be bypassed if desired.

4 Claims, 6 Drawing Sheets

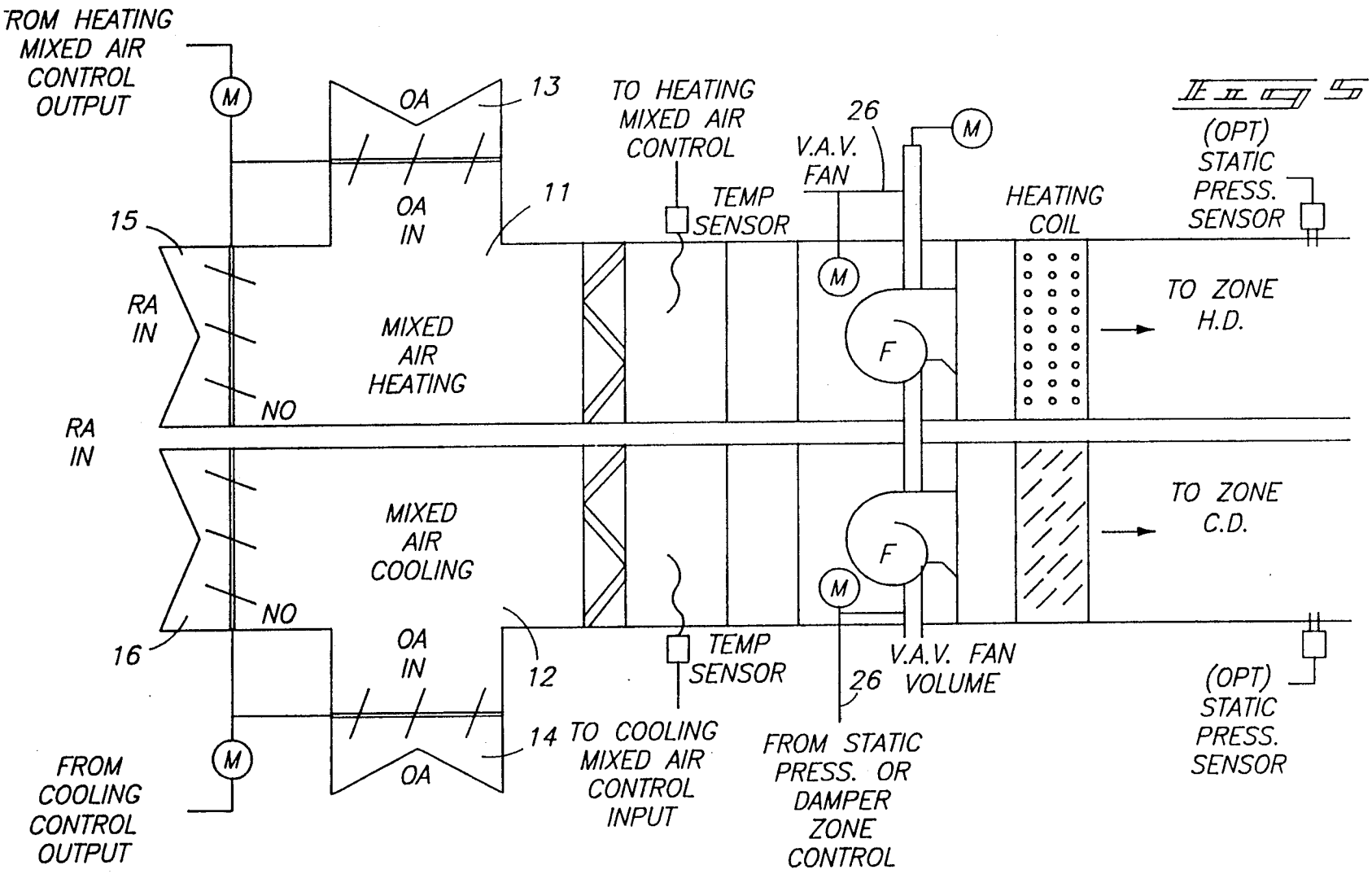
(OPT) STATIC PRESS. SENSOR
TO ZONE H.D.
TO ZONE C.D.
(OPT) STATIC PRESS. SENSOR
HEATING COIL
V.A.V. FAN VOLUME
26
V.A.V. FAN
26
FROM STATIC PRESS. OR DAMPER ZONE CONTROL
TEMP SENSOR
TO HEATING MIXED AIR CONTROL
TEMP SENSOR
TO COOLING MIXED AIR CONTROL INPUT
13
11
12
14
OA
OA IN
MIXED AIR HEATING
MIXED AIR COOLING
OA IN
OA
NO
NO
ROM HEATING MIXED AIR CONTROL OUTPUT
15
RA IN
RA IN
16
FROM COOLING CONTROL OUTPUT

AIR HANDLING APPARATUS

BACKGROUND OF THE INVENTION

1. Field of the Invention

The field of invention relates to heating and cooling apparatus, and more particularly pertains to a new and improved air handling apparatus wherein the same is arranged for the precise heating and cooling of various zones.

2. Description of the Prior Art

Various air handling apparatus has been utilized in the prior art for controlling and monitoring air flow into various zones of commercial buildings. Typically, recirculated air and outside air is mixed into a central deck utilizing various monitoring from various portions of the building to direct heating and cooling air. The instant invention attempts to overcome deficiencies of the prior art by providing a separate heating mixing air deck and a separate cooling mixing air deck to thereby maximize indoor air directed to the heating deck and monitor the cooling deck to utilize either return or outside air for greatest efficiency in dropping cooling air directed from the cooling deck.

Examples of prior art air handling apparatus is exemplified in the prior art by U.S. Pat. No. 4,874,127 to Collier wherein various output and inflow control dampers are utilized in controlling of air flow.

U.S. Pat. No. 2,804,816 to Hoyer sets forth an air conditioning system utilizing return air in the cooling system.

U.S. Pat. No. 2,801,581 to Sprinchorn sets forth an example of a duct work utilized in a heating or air handling system throughout a building.

U.S. Pat. No. 4,632,020 sets forth an air conditioning system for a room utilizing heating or cooling elements for use in controlling air temperature within the room.

As such, it may be appreciated that there continues to be a need for a new and improved air handling apparatus as set forth by the instant invention which addresses both the problems of ease of use as well as effectiveness in construction in minimizing energy use and elevating or depressing temperatures within a living environment and in this respect, the present invention substantially fulfills this need.

SUMMARY OF THE INVENTION

In view of the foregoing disadvantages inherent in the known types of air handling apparatus now present in the prior art, the present invention provides an air handling apparatus wherein the same utilizes a separate mixing deck for heating and cooling, each including a separate return air and outside air system to maximize efficiency in the heating and cooling of various zones within a building. As such, the general purpose of the present invention, which will be described subsequently in greater detail, is to provide a new and improved air handling apparatus which has all the advantages of the prior art air control apparatus and none of the disadvantages.

To attain this, the present invention provides an air handling apparatus to utilize a plurality of air mixing decks, with one of the plurality of decks utilized for the mixing of heated air, with a second of the plurality of decks utilized for mixing of cooling air, wherein the heating and cooling air decks are intercommunicated by associated operative dampers to provide for a precise final product of discharge air into a room and providing a single conduit from the heating and cooling decks for each room. Return air and outside air are accordingly monitored for each of the heating and cooling decks for efficiency of heating and cooling of each room.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved air handling apparatus which has all the advantages of the prior art air control apparatus and none of the disadvantages.

It is another object of the present invention to provide a new and improved air handling apparatus which may be easily and efficiently manufactured and marketed.

It is a further object of the present invention to provide a new and improved air handling apparatus which is of a durable and reliable construction.

An even further object of the present invention is to provide a new and improved air handling apparatus which is susceptible of a low cost of manufacture with regard to both materials and labor, and which accordingly is then susceptible of low prices of sale to the consuming public, thereby making such air handling apparatus economically available to the buying public.

Still yet another object of the present invention is to provide a new and improved air handling apparatus which provides in the apparatuses and methods of the prior art some of the advantages thereof, while simultaneously overcoming some of the disadvantages normally associated therewith.

Still another object of the present invention is to provide a new and improved air handling apparatus wherein the same utilizes separate heating and cooling air decks to minimize energy use in directing air at a predetermined temperature into a dwelling or building.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is an orthographic view illustrating the use of variable air volume fans for use in association with the instant invention.

DESCRIPTION OF THE PREFERRED EMBODIMENT

Figure 1:
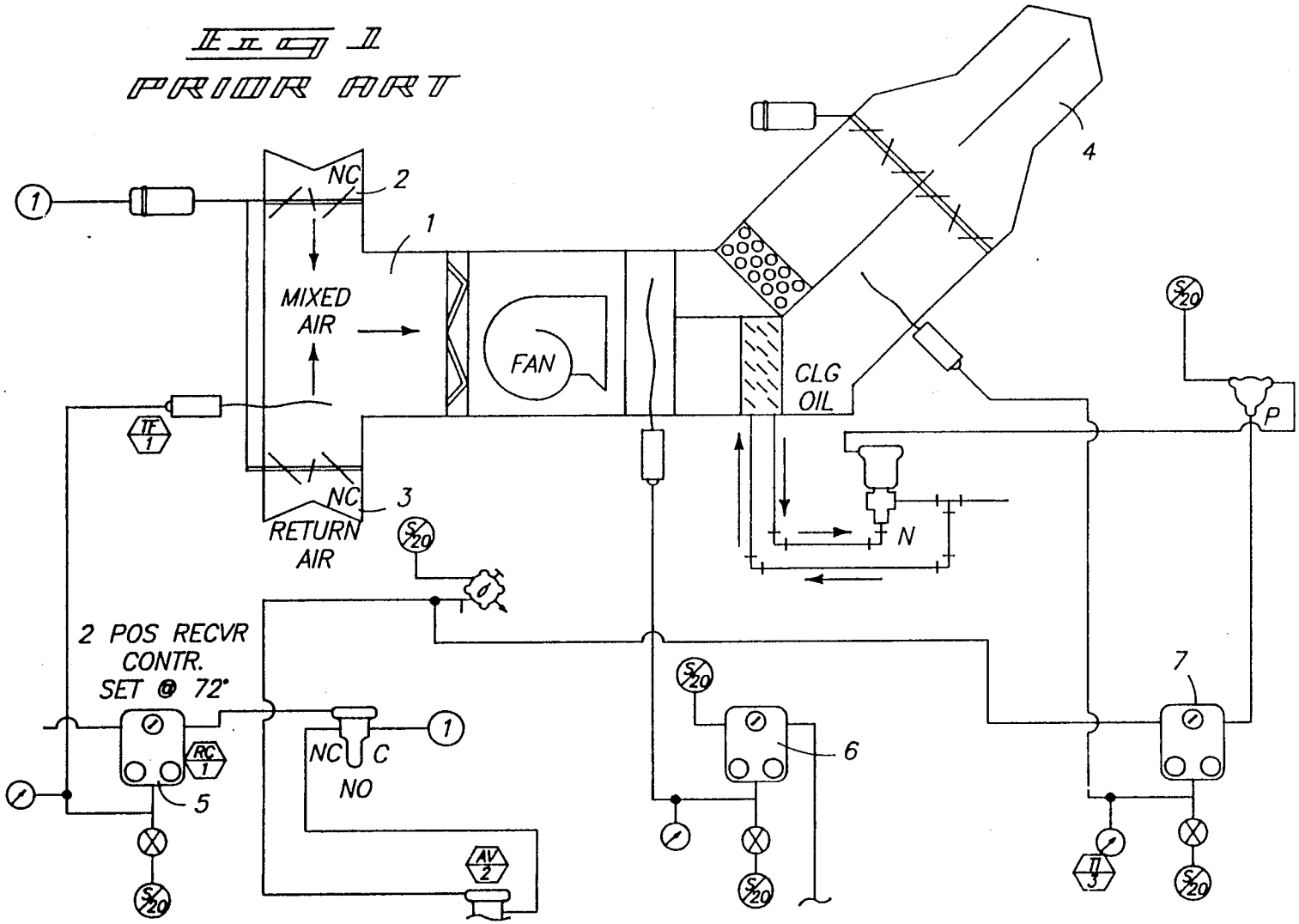
FIG. 1 PRIOR ART
FIG. 1 is a diagrammatic illustration of a prior art air handling apparatus.
Figure 2:
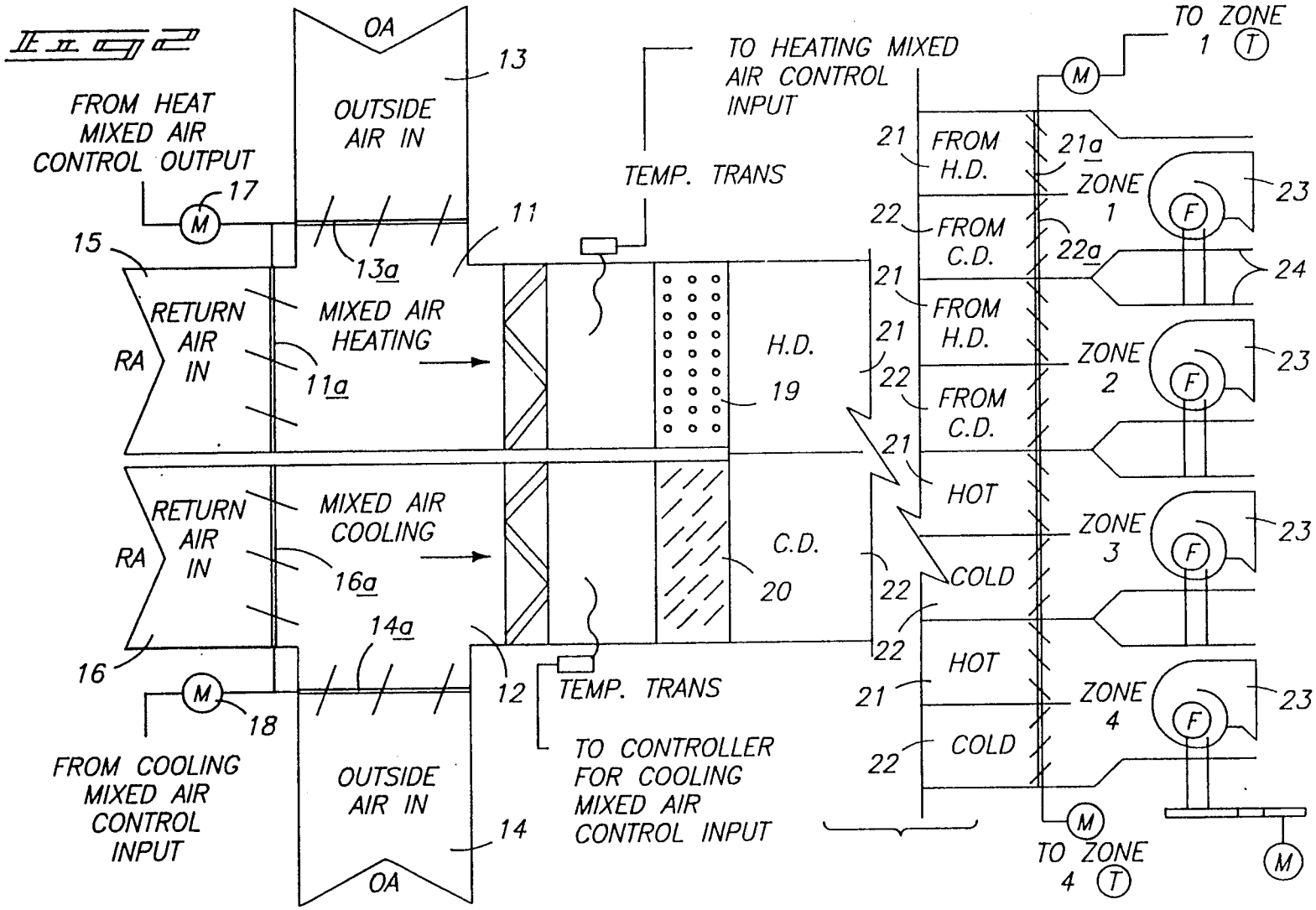
FIG. 2 is a diagrammatic illustration of the mixing and cooling deck structure utilized by the instant invention.

With reference now to the drawings, and in particular to FIGS. 1 to 6 thereof, a new and improved air handling apparatus embodying the principles and concepts of the present invention and generally designated by the reference numerals 11 through 40 will be described.

More specifically, the air handling apparatus of the instant invention includes an improvement over prior art air handling apparatus, as typified by FIG. 1, wherein a central mixing deck 1 utilizes outside air through an outside air duct and return air from a return air duct from the dwelling to direct such air in a pressurized manner utilizing a fan member to direct such air through an associated discharge air duct 4. A plurality of controllers, such as a first, second, and third controller 5, 6, and 7 are utilized with appropriate sensors positioned within the duct work to control the various ducts and thereby monitor the proportion of outside to return air directed into the mixed air or central mixing deck 1.

Figure 3:
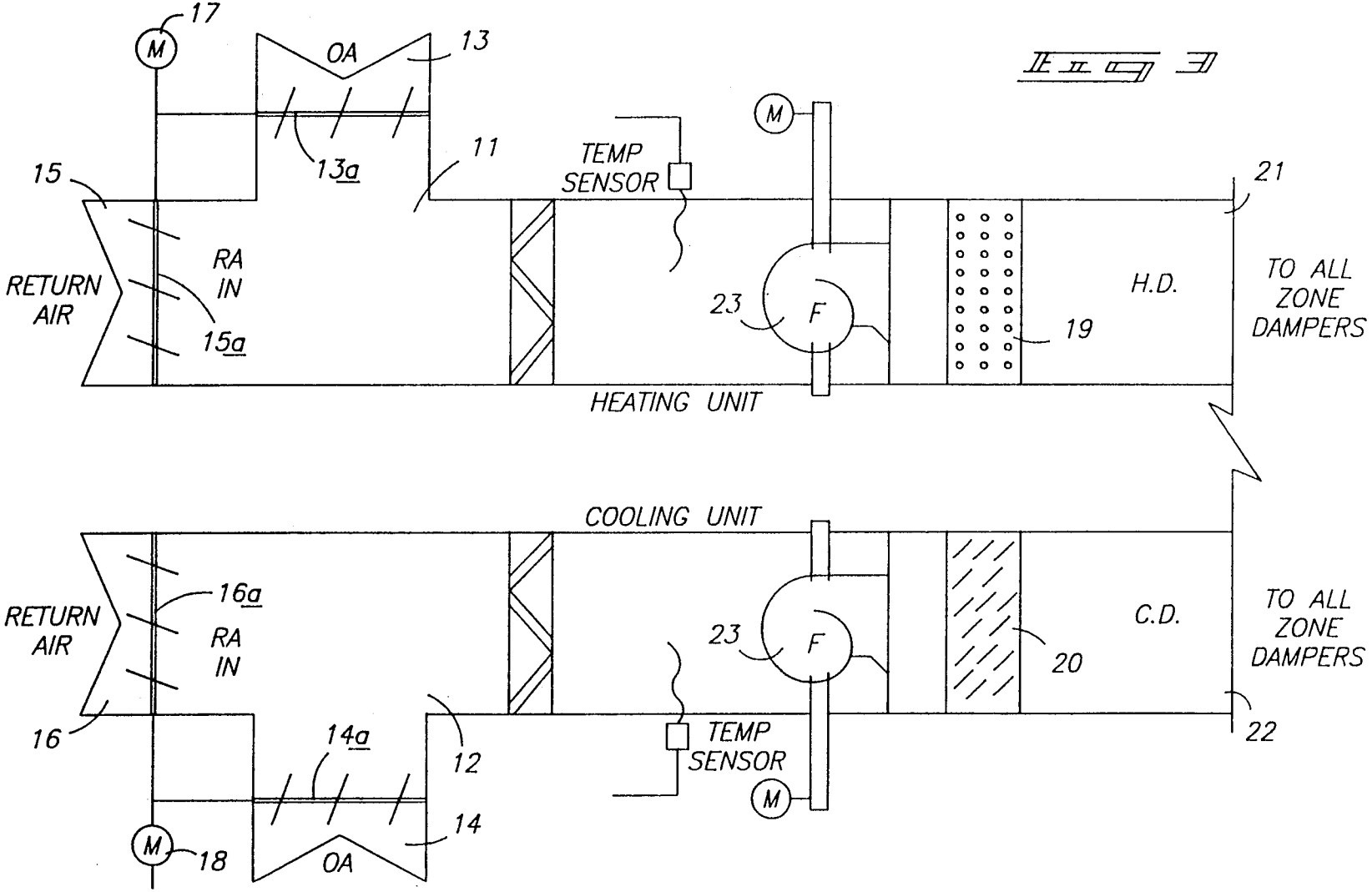
FIG. 3 is an orthographic diagrammatic illustration of the heating and cooling decks directing the air to associated room air conduits.
Figure 4:
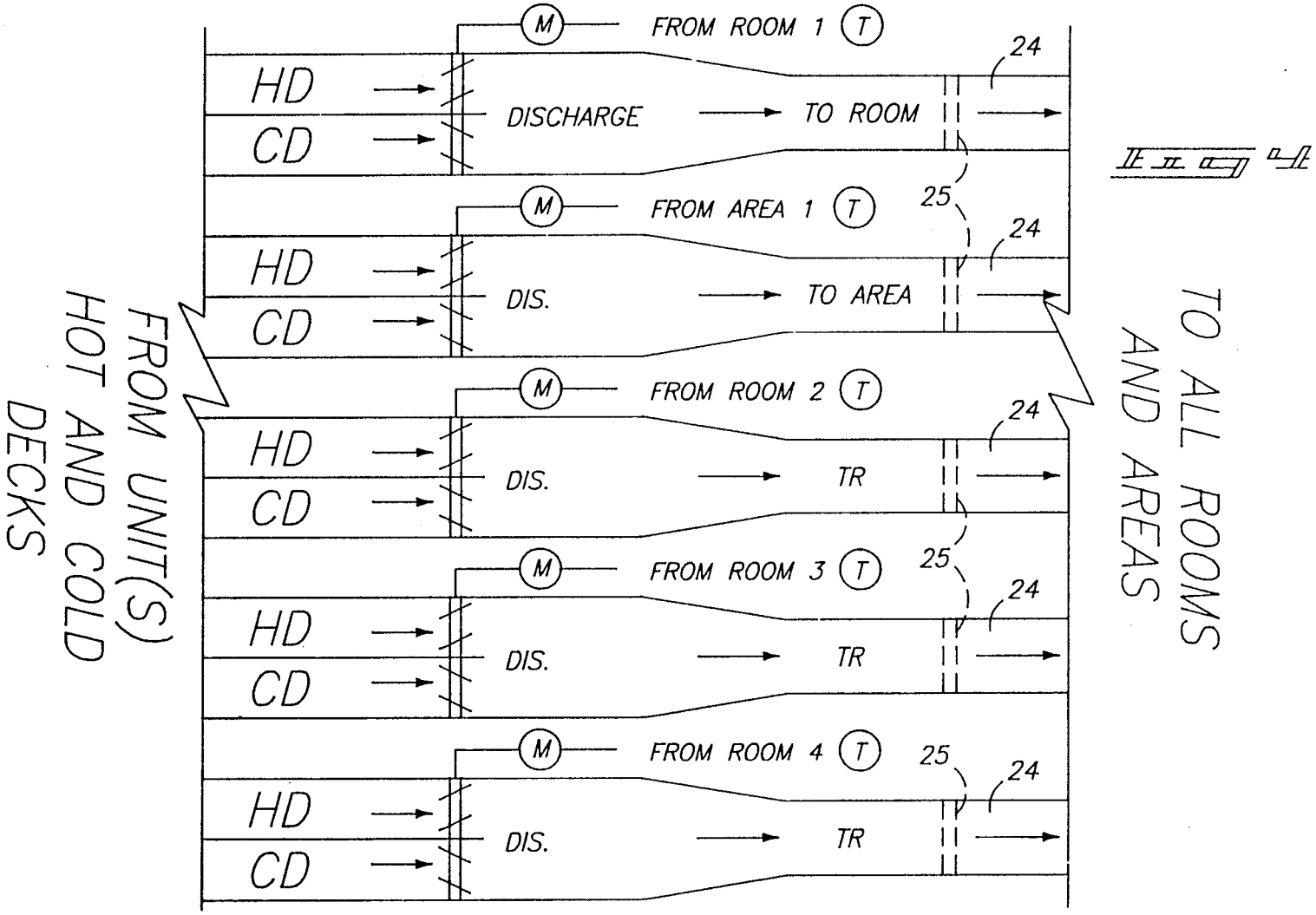
FIG. 4 is an orthographic illustration of the room air conduits receiving air through associated dampers from the heating and cooling decks.
Figure 6:
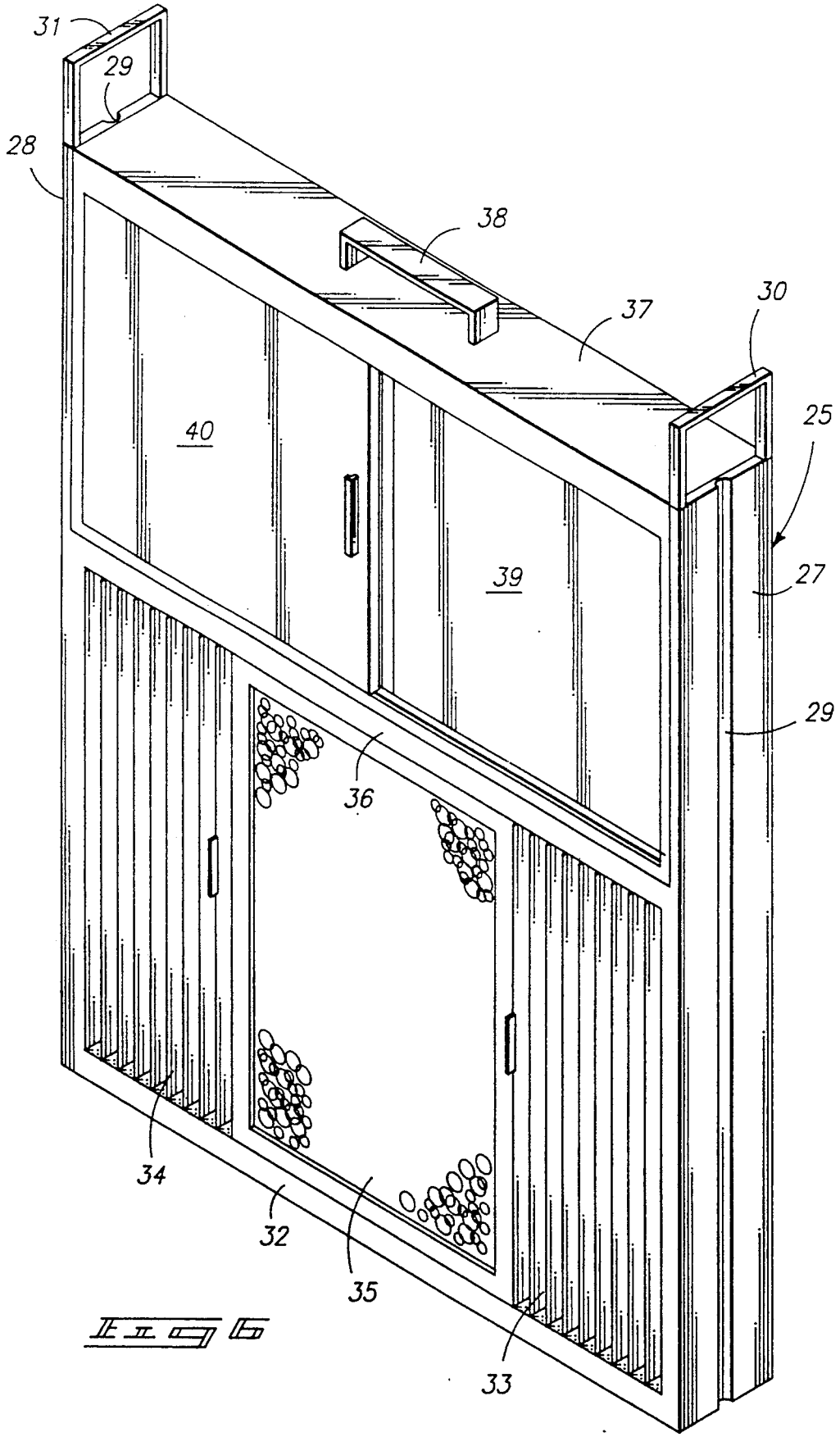
FIG. 6 is an isometric illustration of control plates utilized by the instant invention.

The apparatus includes a heating air plenum 11 separated from a cooling air plenum 12. The heating air plenum 11 includes an outside air first air intake duct 13 and a return air first intake duct 15. The cooling air plenum 12 includes an outside air second intake air duct 14 and a return air second intake duct 16. A heating air damper control motor 17 includes a first intake damper 13*a* and a first return damper 15*a* of the respective first outside air and return air ducts 13 and 15 respectively. A cooling air damper control motor 18 includes a second intake damper 14*a* and a second return damper 16*a* of the associated outside air second duct 14 and the return air second duct 16 respectively. The dampers 13*a*, 14*a*, 15*a*, and 16*a* are operative through controller units and temperature sensor organizations typical of a schematic, as illustrated in FIG. 1, and will not be discussed in further detail. A heating member 19 is mounted within the heat air duct 21 of the heating air plenum 11, with a cooling member 20 directing refrigerant therethrough mounted within the cooling air duct 22 of the cooling air plenum 12. A blower fan 23 may be mounted within the heating and cooling ducts 21 and 22, as illustrated in FIG. 3, or may be positioned within room air conduits 24 downstream from associated heating deck dampers 21*a* and cooling deck dampers 22*a* presenting various volumes of heating of cooling air into the associated room air conduits 24. Further, variable air volume fan control organizations 26 (see FIG. 5) may be utilized within the heat air ducts 21 and the cooling air ducts 22 to also alter air flow volume through the duct work.

Further, within each of the room air conduits 24 receiving a mixing of heating and cooling air from the respective heating and cooling decks through the respective heat air ducts 21 and the cooling air ducts 22, may utilize a control plate 25 (see FIG. 6) that is mounted within the room air conduits 24. The control plate 25 is formed with a "U" shaped frame 27 formed with a first side leg parallel to and spaced from a second side leg 28, with each side including a mounting groove 29 to receive within a complementary projection within the side walls of the room air conduits 24. A first handle 30 and a second handle 31 are mounted to upper terminal ends of respective first and second side legs 27 and 28 for ease of manual manipulation and positioning of each of the control plates 25 within a respective air conduit 24. A bottom frame leg 32 is orthogonally mounted to lower terminal ends of the first and second side legs 27 and 28, with an intermediate frame 36 spaced above and parallel the bottom frame leg 32, but below the upper terminal ends of the first and second side legs 27 and 28. Respective first and second accordion doors 33 and 34 are mounted within the bottom frame leg 32 and the respective first and second side legs 27 and 28 to accommodate various filters 35, wherein the filters 35 are arranged to include a germicide, as well as a perfumed scented container within the filter for enhancing quality of air directed into the various rooms. A slide-in air control unit 37 is slidably mounted between the intermediate frame 36 and the upper terminal ends of the first and second side legs 27 and 28 that includes a handle 38 mounted medially to a top frame plate of the intermediate frame 36. An opening 39 is mounted within the slide-in air control unit 37 defining substantially forty to fifty percent of the area defined by the intermediate frame 36, with a sliding door 40 slidably arranged to permit access of air through the opening 39 at various levels from zero to one hundred percent opening of the opening 39 to permit bypassing of the filter 35 if desired.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An air handling apparatus, comprising in combination, a heating air plenum, the heating air plenum spaced from a cooling air plenum, the heating air plenum including an outside air first intake air duct directed into the heating air plenum, and a return air first intake duct directed into the heating air plenum remote from the outside air first intake duct, and the cooling air plenum including a cooling air plenum outside air second intake duct, and the cooling air plenum further includes a return air second intake duct spaced from and remote from the outside air second intake duct, and each duct including an air flow damper, and a heated air conduit directed from the heating air plenum and heating means in communication with the heated air conduit for heating of air directed therethrough, and a cooling air conduit directed from the cooling air plenum, and cooling means positioned in communication with the cooling air conduit for cooling of air directed therethrough, and the heated air conduit including a heated air conduit damper, and the cooling air conduit including a cooling air conduit damper, and a first blower fan mounted within the heated air conduit, and a second blower fan mounted within the cooling air conduit, and a plurality of room air conduits, and each room air conduit of the plurality of room air conduits in pneumatic communication with the heated air conduit and the cooling air conduit, and wherein each heating air conduit damper is positioned within the heated air conduit adjacent each room air conduit, and each cooling air conduit damper positioned in the cooling air conduit adjacent each room air conduit, and wherein each of said room air conduits including a control plate removably mounted therewithin, each control plate orthogonally oriented relative to air flow through each room air conduit, and each control plate including a "U" shaped framework, including a first side leg spaced from and parallel a second side leg orthogonally mounted to a bottom frame leg, and an intermediate frame mounted orthogonally between the first side leg and the second side leg spaced above and parallel the bottom frame leg and below an upper terminal end of the first side leg and second side leg, and a first accordion door mounted between the intermediate frame and the bottom frame extending from the first side leg, and a second accordion door mounted intermediate the bottom frame leg and the intermediate frame extending from the second side leg, and a filter member mounted between the first accordion door and the second accordion door between the intermediate frame and the bottom frame leg, the filter including a germicide contained therewithin.

2. An apparatus as set forth in claim 1 wherein the control plate includes a slide-in air control unit mounted between the first side leg and the second side leg above the intermediate frame, and the air control unit including a handle mounted to the air control unit to permit manual grasping of the air control unit relative to the first side leg and second side leg.

3. An apparatus as set forth in claim 2 wherein the first side leg includes a first handle mounted to the upper terminal end of the first side leg, and wherein the second side leg includes a second handle mounted to the second side leg to the upper terminal end of the second side leg.

4. An apparatus as set forth in claim 3 wherein the air control unit includes an opening directed through the air control unit, and a sliding door member selectively slidable over the opening permitting selective air flow through the opening to bypass the filter.

* * * * *